US008578629B2

(12) United States Patent
Bosomworth et al.

(10) Patent No.: US 8,578,629 B2
(45) Date of Patent: Nov. 12, 2013

(54) FOOTWEAR

(75) Inventors: Warren Bosomworth, Annecy-le-Vieux (FR); Rene Borel, Saint Sylvestre (FR); Guillaume Amphyon, Annecy (FR); Pascal Stryjak, Saint Eusebe (FR)

(73) Assignee: Salomon S.A.S., Metz-Tessy (FR)

( * ) Notice: Subject to any disclaimer, the term of this patent is extended or adjusted under 35 U.S.C. 154(b) by 500 days.

(21) Appl. No.: 12/643,327

(22) Filed: Dec. 21, 2009

(65) Prior Publication Data

US 2010/0154257 A1 Jun. 24, 2010

(30) Foreign Application Priority Data

Dec. 22, 2008 (FR) ..... 08 07363

(51) Int. Cl.
*A43B 13/00* (2006.01)

(52) U.S. Cl.
USPC ..... 36/25 R; 36/102; 36/114

(58) Field of Classification Search
USPC ..... 369/25 R, 30 R, 31, 28, 102, 114; 36/25 R, 30 R, 31, 28, 102, 114
See application file for complete search history.

(56) References Cited

U.S. PATENT DOCUMENTS

| | | | | |
|---|---|---|---|---|
| 4,615,126 | A * | 10/1986 | Mathews | 36/102 |
| 6,412,196 | B1 * | 7/2002 | Gross | 36/102 |
| 6,920,705 | B2 * | 7/2005 | Lucas et al. | 36/25 R |
| 7,013,582 | B2 * | 3/2006 | Lucas et al. | 36/28 |
| 7,467,484 | B2 * | 12/2008 | Chang et al. | 36/30 R |
| 2003/0208929 | A1 * | 11/2003 | Lucas et al. | 36/28 |
| 2006/0137228 | A1 | 6/2006 | Kubo et al. | |
| 2006/0156579 | A1 * | 7/2006 | Hoffer et al. | 36/28 |
| 2007/0033833 | A1 * | 2/2007 | Chang et al. | 36/30 R |
| 2008/0289221 | A1 * | 11/2008 | Munns | 36/89 |

FOREIGN PATENT DOCUMENTS

WO WO-2006/023773 A1 3/2006

* cited by examiner

*Primary Examiner* — Marie Patterson
(74) *Attorney, Agent, or Firm* — Greenblum & Bernstein, P.L.C.

(57) ABSTRACT

An article of footwear, such as a shoe, which includes an outer sole assembly and an upper, the sole assembly including a first comfort layer and a reinforcement layer, the first comfort layer being located between the reinforcement layer and the upper. The reinforcement layer includes a first portion and a second portion connected to one another by a bridge, the first and second portions being fixed to the comfort layer, the bridge being opposite the comfort layer and not fixed to the comfort layer.

30 Claims, 5 Drawing Sheets

2
22
35
23
21
$l_2$
$l_1$
48
16
15

FOOTWEAR

CROSS-REFERENCE TO RELATED APPLICATION

This application claims priority under 35 U.S.C. §119 of French Patent Application No. 08 07363, filed on Dec. 22, 2008, the disclosure of which is hereby incorporated by reference thereto in its entirety.

BACKGROUND OF THE INVENTION

1. Field of the Invention

The invention relates to footwear generally and, more particularly, to a walking or sports shoe.

Shoes of the walking or sports type are used in fields such as walking, running on flat or mountainous terrain, skateboarding, ball sports, and the like.

2. Description of Background and other Information

An article of footwear, hereafter "shoe" for convenience, can include a low upper, a high upper, or a mid-height upper. The shoe can also be relatively flexible or, on the contrary, more rigid. However, it is desirable in any case that the shoe sole assembly provide a certain comfort. This means in particular that the sole assembly must dampen forces or the transmission of sensory information related to walking. This also means that the sole assembly must be as lightweight as possible in order to limit the shoe inertia and the fatigue resulting therefrom.

For these reasons, the outer sole assembly, in a number of walking or sports shoes, includes a comfort layer which fulfills a damping role, while conferring a certain lightness to the shoe. However, a comfort layer alone does not necessarily fulfill all of the expected functions of a sole assembly. Indeed, the sole assembly is useful in facilitating walking by means of storing and then releasing at least a portion of the energy generated during foot rolling movement.

To this end, it is known to arrange a reinforcement layer in the sole assembly, so that the comfort layer is located between the upper and the reinforcement layer. The latter, with respect to the simplest sole assemblies, also plays the role of a walking sole. For example, the reinforcement layer can include rubber, a material that improves the grip on the ground. Moreover, the reinforcement layer is capable of storing, and then restoring, at least a portion of the energy generated during the foot rolling movement. Indeed, a rolling movement tensions the reinforcement layer. It is the distance between the upper and the reinforcement layer, i.e., in other words, the thickness of the comfort layer, which enables the tensioning. This tensioning is all the more strong as the comfort layer is thick. At the end of the foot rolling movement, at the moment when the shoe leaves the ground, the energy generated by the tension of the reinforcement layer, namely the walking sole in this case, tends to return the sole assembly to its initial form. It is a spring effect provided to the sole assembly by the walking sole. This effect propels the shoe forward, in the walking direction. The advantage is fatigue reduction for the user, who is required to produce less energy for an equivalent stride.

The benefit of the spring effect, if it occurs, remains however incomplete. For example, there is an inadequate distribution of this effect, in the sense that it is insufficient in certain areas and excessive in others. Moreover, the spring effect is sometimes insufficient in the areas in which it is useful.

SUMMARY

In view of the above, the invention increases the spring effect, i.e., the ability to propel the shoe, provided by the sole assembly.

In addition, the invention optimizes the distribution of the spring, or rebound, effect, i.e., to apply the same mostly where it is useful.

Still further, the invention provides for a reduction in the weight of the sole assembly, and provides the assembly with a simplified structure.

To this end, the invention is directed to an article of footwear, referred to herein for convenience as a shoe, which includes an outer sole assembly and an upper, the sole assembly including a first comfort layer and a reinforcement layer, the first comfort layer being located between the reinforcement layer and the upper.

The reinforcement layer of the shoe of the invention includes a first portion and a second portion connected to one another by means of a bridge, the first and second portions being fixed to the comfort layer, the bridge being opposite the comfort layer and not fixed thereto. In other words, the bridge is opposite the comfort layer, and is freer with respect to the latter, in comparison with the first and second portions.

The fixing of the first and second portions, in at least a particular embodiment, refers to an attachment that prevents a relative movement between the comfort layer and the first and second portions. This attachment, or fixing, can be manifested by an adhesive, or glue, for example. The bridge is opposite the comfort layer without being fixed thereto. Thereby, the bridge can become deformed in a reversible lengthening direction. In other words, a portion of the reinforcement layer, namely the bridge, can be reversibly tensioned when the sole assembly bends. The bending of the sole assembly is related to the foot rolling movement.

As a result, each bridge is capable of accumulating and releasing the energy generated during the foot rolling movement. The accumulation and the release are optimized because the bridge is not fixed to the comfort layer.

Therefore, the invention, in contrast with the prior art, has the advantage of increasing the spring effect of the sole assembly. Consequently, the invention also improves the damping, as well as the lengthening of a bridge that reduces the intensity of the impulses or of the sensory information.

Because each bridge can be arranged where necessary, the distribution of the spring effect can be optimized.

Other advantages include the lightness and simplified structure of the sole assembly.

BRIEF DESCRIPTION OF THE DRAWINGS

Other characteristics and advantages of the invention will be better understood from the description that follows, with reference to the annexed drawings illustrating, by way of non limiting embodiments, how the invention can be implemented, and in which.

DETAILED DESCRIPTION

The first embodiment, which is described hereinafter, relates more particularly to shoes for walking or running on flat or uneven terrain. However, the invention applies to other fields, such as those mentioned hereinabove.

The first embodiment is described hereinafter with reference to FIGS. 1 to 6.

Figure 1:
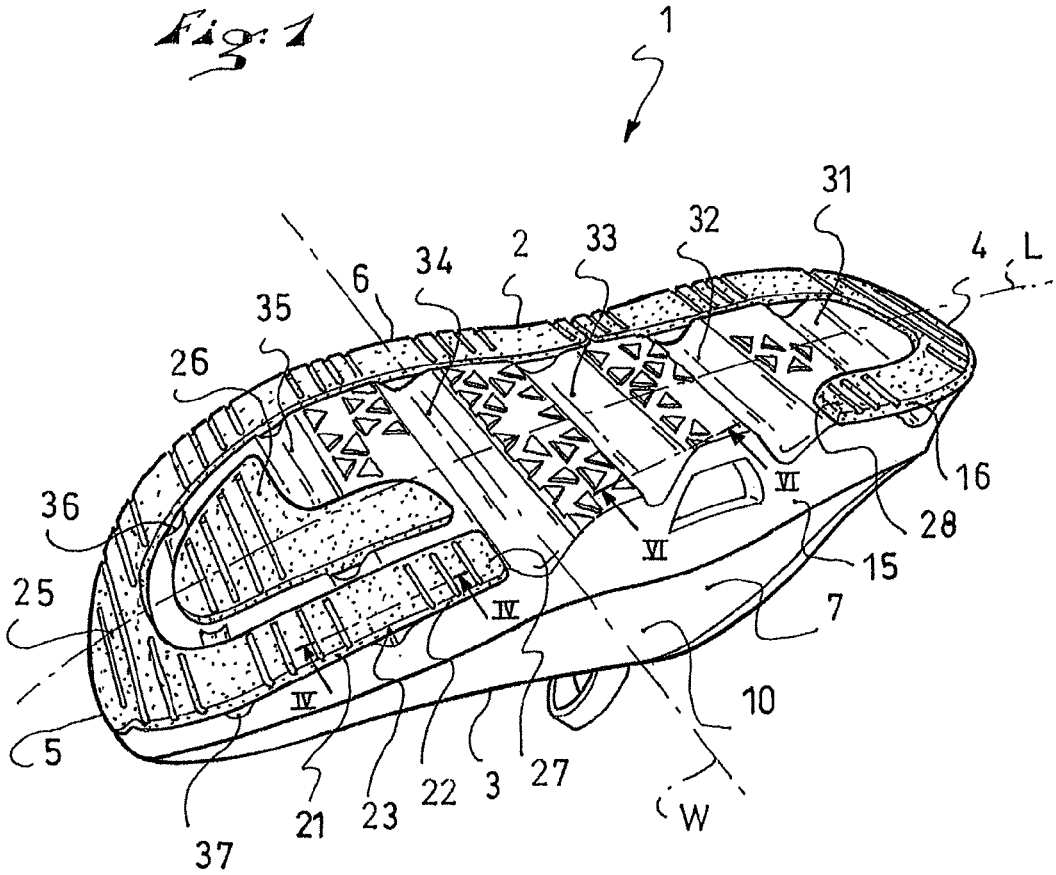
FIG. 1 is a front perspective bottom view of a shoe according to a first embodiment of the invention.

As shown in FIG. 1, a walking shoe is provided to receive the user's foot.

In a known manner, the shoe 1 includes an outer sole assembly 2 and an upper 3 arranged on the sole assembly. The shoe 1 extends lengthwise along a longitudinal direction L, between a rear end 4, or heel, and a front end 5, or tip, and widthwise along a transverse direction W, between a lateral side 6 and a medial side 7.

As shown, the upper 3 includes a lower portion 10 that is provided to surround the foot but does not include an upper portion that might extend up to and/or beyond the ankle. However, the upper could also be provided to include an upper portion.

Figure 2:
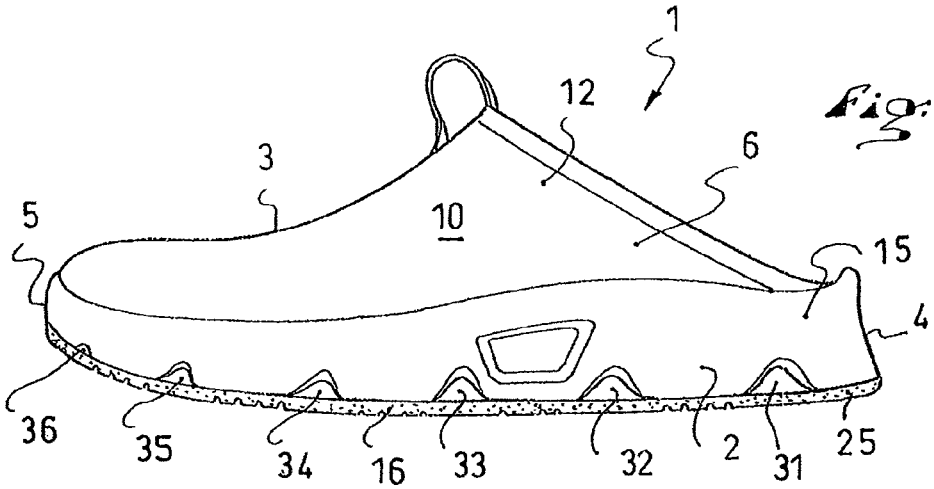
FIG. 2 is a side view, for example the lateral side, of the shoe of FIG. 1.
Figure 3:
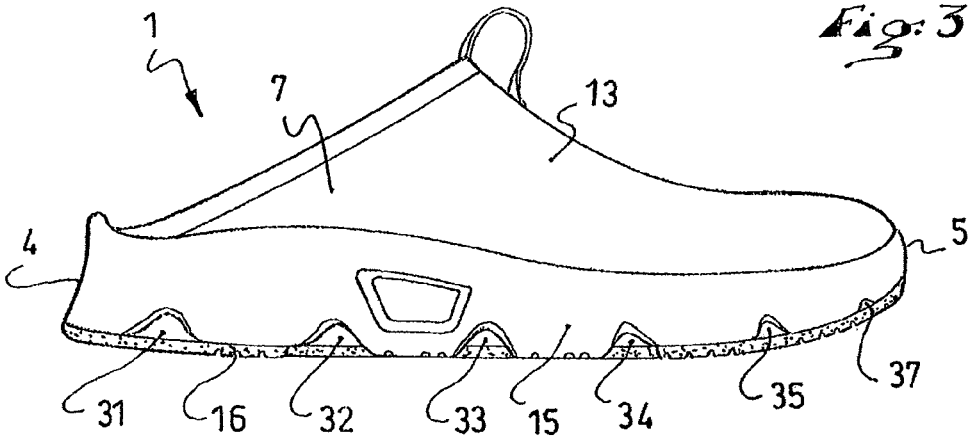
FIG. 3 is similar to FIG. 2, but relates to the medial side.

According to the first embodiment, as shown in FIGS. 2 and 3 in particular, the shoe 1 is a slipper. This means that the user's heel is at least partially exposed, because the height of the upper is reduced towards the rear end 4. Alternatively, however, the invention encompasses a more conventional upper, in which the user's heel is completely covered. In such a case, the upper, although it remains low, is raised in the area of the heel 4.

The shoe 1 is structured to allow for a good foot rolling movement when walking, as well as to provide for the transmission of sensory information and forces for supports or landings. For these reasons, the outer sole assembly 2 and the upper 3 are relatively flexible.

The upper 3 includes a lateral quarter 12 and a medial quarter 13. However, a tongue could be added, which would connect the quarters 12, 13 to one another in order to provide continuity to the upper 3.

The upper 3 is affixed to the sole assembly 2 by gluing, stitching, or any other means, such as nesting.

The outer sole assembly 2 includes a first comfort layer 15 and a reinforcement layer 16, the first comfort layer 15 being located between the reinforcement layer 16 and the upper 3.

According to the first embodiment, and in a non-limiting manner, the first reinforcement layer 16 is an outsole, i.e., it includes a ground-engaging surface. As such, it provides sufficient grip on the ground and resists wear and tear. The reinforcement layer 16 includes rubber or other elastomer, for example, or any suitable material, including polyurethane or an equivalent.

According to the invention, as illustrated in FIGS. 1 to 6, the reinforcement layer 16 includes a first portion 21 and a second portion 22 connected to one another by a bridge 23, the first 21 and second 22 portions being fixed to the comfort layer 15, the bridge 23 being opposite the comfort layer 15 and not fixed thereto. The bridge of the reinforcement layer is therefore freer with respect to the comfort layer, in comparison with the first 21 and second 22 portions. As shown in FIGS. 2 and 3, e.g., the bridge 23 is spaced from, beneath, and opposite the comfort layer 15, the bridge including a portion of the ground-engaging surface of the reinforcement layer. And, as explained below, between each of the illustrated bridges and the comfort layer is a respective cavity 31 to 37.

In fact, in view of the freer movement of the bridge 23, the bridge is structured and arranged to lengthen elastically, in a reversible fashion, i.e., to extend and contract, between the portions 21, 22. As can be seen in FIGS. 2 and 3, e.g., the bridge 23 is co-extensive with the portions 21, 22. In this regard, it can be said that the bridge extends longitudinally at a height that is within the thickness of the portions 21, 22, i.e., the thickness of the bridge does not rise above the thickness of the portions 21, 22. Further, as shown in the drawings, the lowermost or ground-engaging surface of the bridge 23 is flush with the lowermost or ground-engaging surfaces of the portions 21, 22. The lengthening, or extension, occurs when the sole assembly bends by increasing the convexity of the reinforcement layer 16, during the foot rolling movement on the ground. Then, the lifting of the foot moves the sole assembly away from the ground, and the bridge 23 is restored to its initial length. This provides the sole assembly and, therefore, the shoe, with a driving force.

According to the first embodiment, as shown in FIG. 1, the reinforcement layer 16 is fragmented or segmented. In this case, the reinforcement layer 16 includes a plurality of pieces, including a peripheral piece 25 and an inner piece 26.

The peripheral piece 25 is extensible in the direction of its length, from a first end 27 to a second end 28. In a non-limiting fashion, the first end 27 is located on the medial side 7, in the area of the metatarsus, i.e., away from the tip 5. The second end 28 is located on the medial side 7, away from the rear end 4. From the first end 27 to the second end 28, the peripheral piece 25 successively borders the tip 5, the lateral side 6, and the rear end 4.

The inner piece 26 is located in the area of the metatarsus, within the peripheral piece 25. As shown in FIG. 1, the inner piece 26 is positioned between medial and lateral portions of the peripheral piece 25.

The peripheral piece 25 is a band, with a substantially constant width and a substantially constant thickness. The inner piece 26 is a plate with a substantially constant thickness. To facilitate and standardize the manufacture of the sole assembly 2, the thickness "e" of the reinforcement layer 16 is the same for the peripheral piece 25 and the inner piece 26. This thickness "e", which is constant for the entire reinforcement layer 16, ranges between 0.5 mm and 5 mm, and, in a more particular set of embodiments, within a range of between 0.8 mm and 2 mm. This thickness can be variable.

The inner piece 26 is separated from the peripheral piece 25 in the plane of, or along the surface of, the reinforcement layer 16. The invention positions each piece 25, 26 of the reinforcement layer, i.e., of the outsole, only where necessary. For the first embodiment, the sole assembly is adapted for walking, such as in an urban environment, for example. For such an adaptation, it is useful to protect the tip, the rear end, and the lateral side 6. In the description that follows, other arrangements and uses are possible.

In a non-limiting fashion, the reinforcement layer 16 is flush with the comfort layer 15. This provides the sole assembly 2 with a more homogeneous structure.

Still according to the first embodiment, cavities 31 to 37, or recesses, are structured and arranged in the first comfort layer 15. In this embodiment, each cavity is an open cavity. Each cavity is a substantially transverse groove, i.e., a groove that extends in a direction that intersects with a longitudinal median plane of the shoe, which opens out in the area of the reinforcement layer 16. A transverse groove shown in FIG. 1 is oriented in the transverse direction W and, in this illustration, is perpendicular or substantially perpendicular to the longitudinal direction L. Given that the reinforcement layer 16 is segmented, a cavity 31 to 37 opens out either opposite the reinforcement layer 16, or in the open air. As can be seen in the drawings, it is also provided for each cavity to open out transversely, in the area of the lateral side 6 or medial side 7 of the shoe. The cavities 31 to 37 promote the bending of the sole assembly 2 when walking. As a result, the foot rolling movement occurs more easily.

In a non-limiting manner, as seen in FIGS. 1-3, for example, the arrangement of the cavities 31 to 37 is carried out as follows. The first cavity 31 extends transversely, near the rear end 4, while opening out opposite the peripheral piece 25 towards the lateral side 6 and medial side 7, and while opening out in open air in the middle of the sides 6, 7.

The second 32, third 33, and fourth 34 cavities extend transversely, between the rear end 4 and the tip 5, while opening out opposite the peripheral piece 25 of the reinforcement layer 16 towards the lateral side 6, and while opening out in open air towards the medial side 7, as well as in the middle of the sides 6, 7.

The fifth cavity 35 extends transversely in the area of the metatarsus, while opening out opposite the peripheral piece 25 towards the lateral side 6 and medial side 7, while opening out opposite the inner piece 26, and while opening out in open air between the peripheral piece and the inner piece.

The sixth cavity 36 is arranged near the tip 5, in the area of the lateral side 6, and opens out opposite the peripheral piece 25.

Finally, the seventh cavity 37 is arranged near the tip 5, in the area of the medial side 7, and opens out opposite the peripheral piece 25.

Here, the cavities 31 to 37 are strictly oriented in the transverse direction, perpendicular to the longitudinal axis of the shoe, and they are parallel to one another. This construction makes slow walks comfortable.

Because of the arrangement of the sole assembly 2, the shoe 1 includes a plurality of bridges, as well as a plurality of portions connected to one another by a bridge. The number of bridges is equal to the number of subdivisions of the reinforcement layer 16 that are opposite a cavity 31 to 37. It is not necessary to describe all of them in detail to understand the invention. By way of example, the bridge 23 described hereinafter is that which is opposite the cavity 35, near the medial side 7. As can be understood from FIGS. 1, 4, and 5, the bridge 23 and portions 21, 22 form an assembly that edges, or borders, the medial side 7. The first portion 21 of the reinforcement layer 16 is fixed to the comfort layer 15, i.e., it is retained thereto permanently. This attachment is achieved by any appropriate means, such as by means of glue, vulcanization, superficial melting of material, or the like. The same is true for the second portion. Finally, the first portion 21 and second portion 22 are fixed to the comfort layer 15, on both sides of the cavity 35.

The bridge 23 connects the portions 21, 22 to one another and, as a result, the cavity 35 is opposite the bridge. This means that the cavity 35 is partially closed by the bridge 23, the bridge not being fixed to the comfort layer, but being spaced therefrom, in this zone.

Generally, at least one cavity 31 to 37 is opposite a bridge.

Because each piece 25, 26 of the reinforcement layer 16 is a unitary piece, the first portion 21, the second portion 22, and the bridge 23 form a continuous subdivision of the layer 16. That is, each subdivision consisting of a first portion, a second portion, and a bridge is itself unitary, i.e., one piece. The portions 21, 22 and the bridge 23 are therefore associated for optimizing the ability of the sole assembly 2 to store and then release the energy related to walking, as shown clearly in FIGS. 4 and 5. It can also be said that all of the subdivisions, each comprised of a respective first portion, second portion, and bridge, together comprise a unitary, continuous subdivision of the reinforcement layer.

Figure 4:
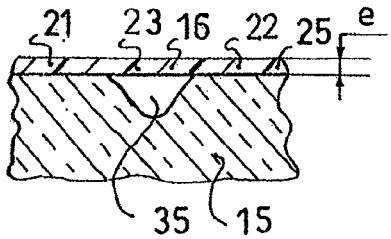
FIG. 4 is a cross section along the line IV-IV of FIG. 1, in the case in which the shoe sole assembly has a natural form.

Initially, FIG. 4 shows that the sole assembly 2 is in a natural configuration, without any bias in a bending direction. This is the case, for example, when the wearer is in the orthostatic position, or when the shoe 1 is apart from the ground when walking. This is a reference configuration of the sole assembly 2, for which the bridge 23 is at rest. The portions 21, 22 and the bridge 23 have the same thicknesses.

Figure 5:
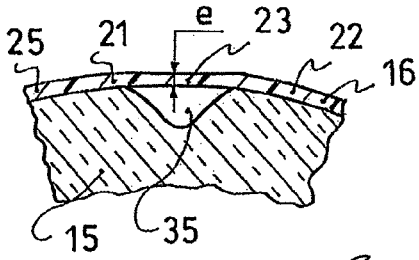
FIG. 5 is similar to FIG. 4, in the case in which the sole assembly bends in correlation with the foot rolling movement when walking.
Figure 6:
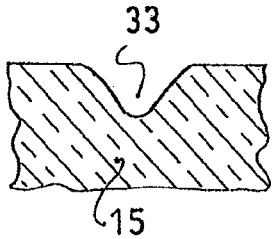
FIG. 6 is a cross section along the line VI-VI of FIG. 1.

Alternatively, according to FIG. 5, the bridge 23 accumulates energy when the sole assembly bends. In this case, it is a mechanical energy related to the reversible elastic deformation of the bridge 23. The rolling movement the foot causes a deformation of the sole assembly 2, in a direction of increase in the convexity of the reinforcement layer 16. Consequently, the bridge 23 lengthens elastically, and the thickness thereof is reduced, whereas the thickness of the first 21 and second 22 portions remains stable. It is noted in parallel that the cavity 35 facilitates the increase in the convexity of the reinforcement layer 16, and that the cavity 35 enables the bridge 23 to have a great freedom of deformation. Each bridge thus behaves as an elastic device, in the manner of a spring, which releases the energy related to the foot rolling movement, at the moment the shoe leaves the ground. Each bridge provides driving impulses, i.e., driving forces, when walking.

More specifically, it appears that the bridges located in the area of the cavities 35, 36, 37, i.e., towards the metatarsus, or the metatarsophalangeal joint and the toes, provide forces that cause the rebound of the shoe. The bridges located in the area of the cavities 32, 33, 34, below the instep, provide forces that stabilize the shoe 1 transversely. Finally, the bridges located in the area of the cavity 31, towards the rear end, oppose an excessive crushing of the sole assembly during rear support.

Other embodiments of the invention are illustrated hereinafter with reference to FIGS. 7 to 11. For reasons of convenience, the common elements shared with the first embodiment are designated by the same reference numerals.

Figure 7:
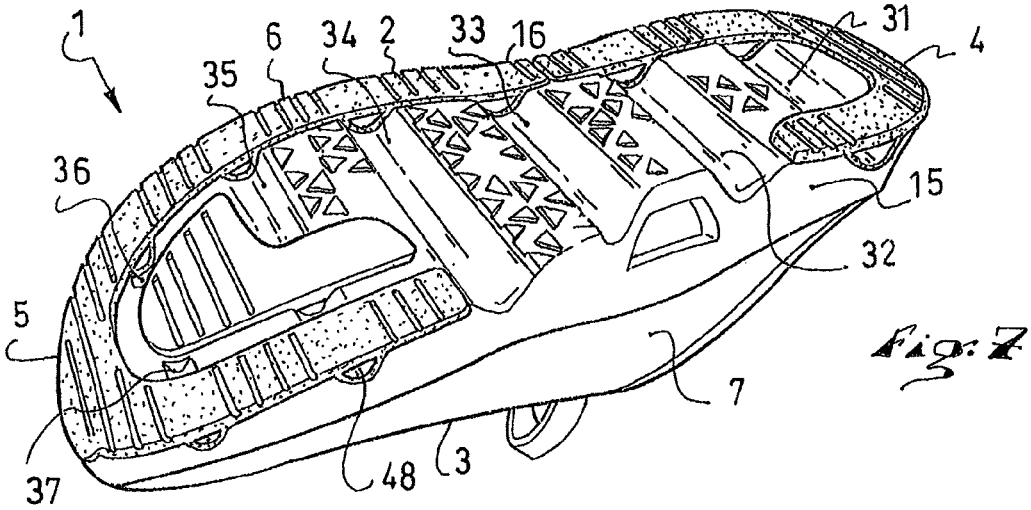
FIG. 7 is similar to FIG. 1, according to a second embodiment of the invention.

The second embodiment, shown in FIG. 7, is similar to the first embodiment. This embodiment features a shoe 1 with its sole assembly 2 and its upper 3, as well as a rear end 4, a tip 5, a lateral side 6, and a medial side 7. The sole assembly 2, as in the first embodiment, includes a first comfort layer 15 and a reinforcement layer 16.

Specific to the second embodiment is the structure of the reinforcement layer 16. The reinforcement layer includes a single peripheral piece 25, which is identical or similar to that of the first embodiment. Moreover, in the area of a cavity, such as the reference cavity 35, the reinforcement layer 16 includes an arch 48 in addition to the first portion 21, second portion 22, and bridge 23. The portions 21, 22, the bridge 23, and the arch 48 form a continuous subdivision of the reinforcement layer 16. In other words, the arch 48, together with the reinforcement layer 16, or at least with a piece 25 of the layer 16, forms a unitary piece. The arch 48 is arranged so as to be opposite the bridge 23, and follows the portion of the comfort layer 15 that demarcates the cavity 35. The arch 48 is thus a lining of the comfort layer in the area of the cavity. In a non-limiting fashion, an arch is provided to be associated with each bridge. This enables a more even contact between the comfort layer 15 and the reinforcement layer 16, without modifying the efficiency of the bridge 23.

Figure 8:
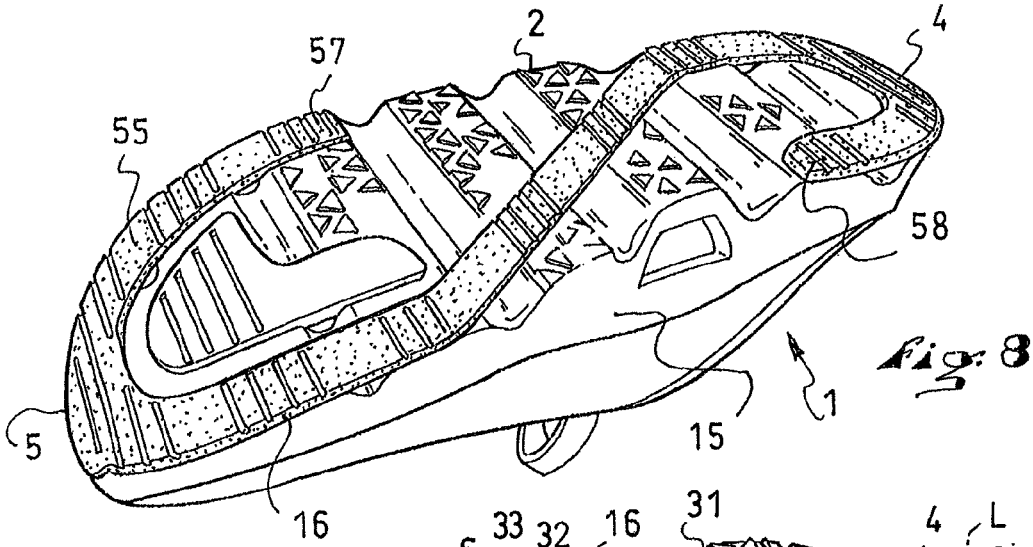
FIG. 8 is similar to FIG. 1, according to a third embodiment of the invention.

The third embodiment is illustrated in FIG. 8. Still in the same context, the sole assembly 2 of a shoe 1 includes a first comfort layer 15 and a reinforcement layer 16.

What is specific to the third embodiment is the structure of the reinforcement layer 16. The reinforcement layer includes a single S-shaped piece 55. This piece 55, or S-shape, extends from a first end 57 to a second end 58. Each end 57, 58 is located in the area of an opposite side of the shoe. In a non-limiting fashion, the first end 57 is located on the lateral side 6, whereas the second end 58 is located on the medial side 7. The reverse arrangement is also encompassed by the invention.

The first end 57 is located in the area of the metatarsus, i.e., spaced from the tip 5. Similarly, the second end is located in an area spaced from the rear end 4. To form the S-shape, the piece 55 edges, or borders, the tip 5 from the lateral side 6 to the medial side 7, extends diagonally from the medial side 7 to the lateral side 6, then edges or borders the rear end 4 from the lateral side 6 to the medial side 7.

The piece 55 is a band with a substantially constant width, comprised for example between 5 mm and 3 cm. Finally, this structure of the reinforcement layer 16, with its piece 55, is adapted to a foot rolling movement that starts with a support on the rear end on the lateral side 6, and ends with a support on the tip, on the medial side 7. This exemplary case relates in particular to shoes for long-distance running, for example.

Figure 9:
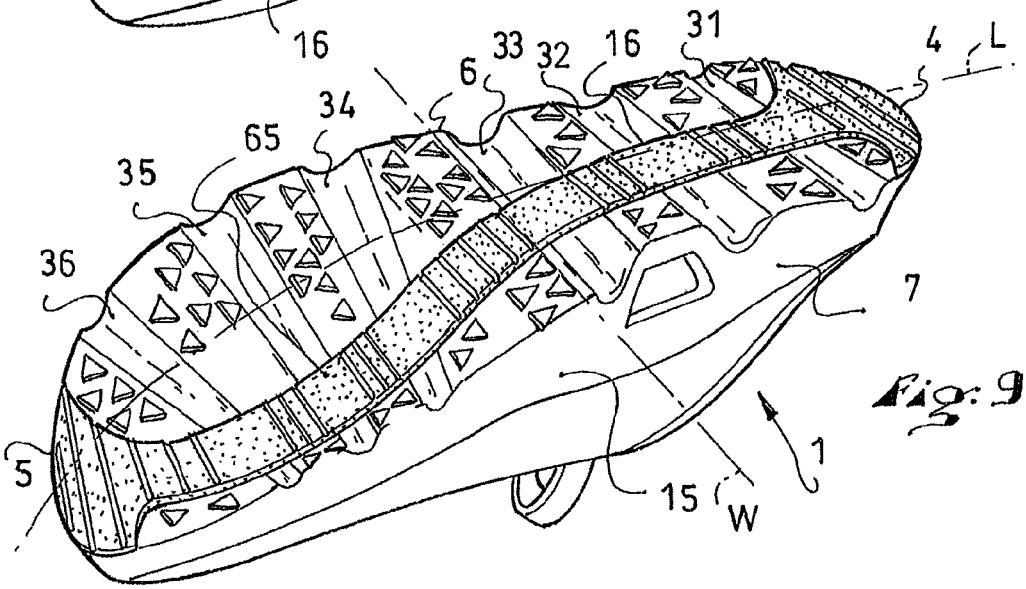
FIG. 9 is similar to FIG. 1, according to a fourth embodiment of the invention.

The fourth embodiment is illustrated in FIG. 9. The sole assembly 2 of the shoe 1 still includes a first comfort layer 15 and a reinforcement layer 16.

What is specific to the fourth embodiment is once again the structure of the reinforcement layer 16. The latter includes a single lengthened and curved piece 65. This piece 65 extends from the rear end 4 to the 5. The piece 65 is centered between the sides 6, 7 towards the rear end 4, so as to extend closer to the medial side 7 as it extends toward the tip 5. This structure and arrangement is well-suited for a flat foot rolling movement of the sole assembly 2.

Moreover, some cavities, for example the three cavities 31, 32, 33 are oriented along the transverse direction W, whereas other cavities, for example the three cavities 34, 35, 36, together with the transverse direction W, form an angle that is comprised between 5° and 30°. Thus, at least one cavity is a groove which, together with the transverse direction W of the shoe, forms an angle that is comprised between 5° and 30°.

Figure 10:
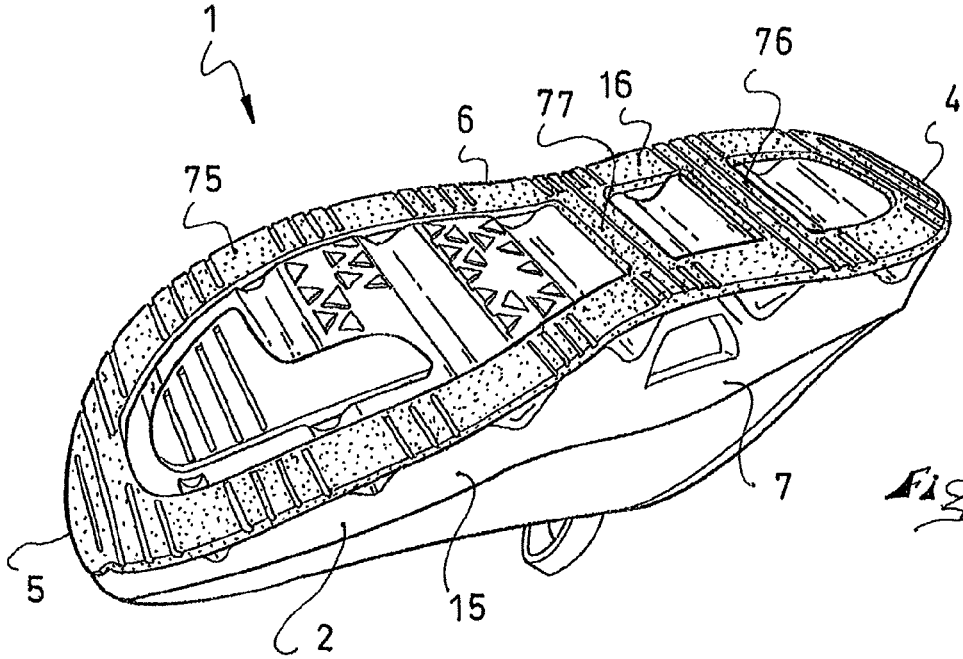
FIG. 10 is similar to FIG. 1, according to a fifth embodiment of the invention.

The fifth embodiment is shown in FIG. 10. The sole assembly 2 of the shoe 1 still includes a first comfort layer 15 and a reinforcement layer 16.

What is specific to the fifth embodiment is once again the structure of the reinforcement layer 16. The latter includes a peripheral belt 75, i.e., a band that edges or borders the entire circumference of the sole assembly 2. Moreover, although this is not mandatory, cross-pieces 76, 77 connect opposite portions of the belt 75 to one another. For example, two cross-pieces 76, 77 extend transversely from the lateral side 6 to the medial side 7. In this case, the belt 75 and cross-pieces 76, 77 form a unitary piece. The shoe 1 provided with such a reinforcement layer 16 is multi-purpose.

Figure 11:
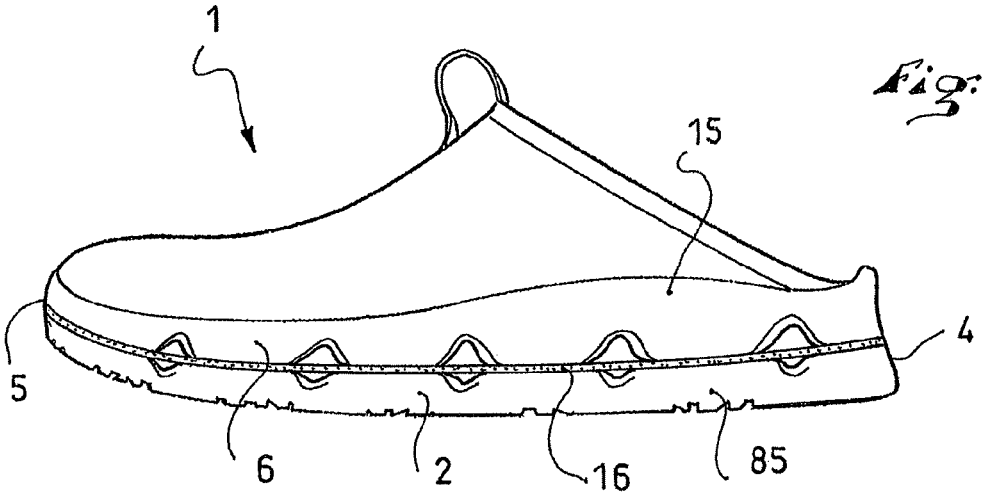
FIG. 11 is a side view of a shoe, according to a sixth embodiment of the invention.

The sixth embodiment is illustrated in FIG. 11. In this case, the sole assembly 2 of the shoe 1 includes not only a first comfort layer 15 and a reinforcement layer 16, but also a second comfort layer 85. The reinforcement layer 16 is located between the first 15 and second 85 comfort layers. This further improves the comfort of the shoe 1, by preserving the ability of the sole assembly 2 to store and then release energy.

Figure 12:
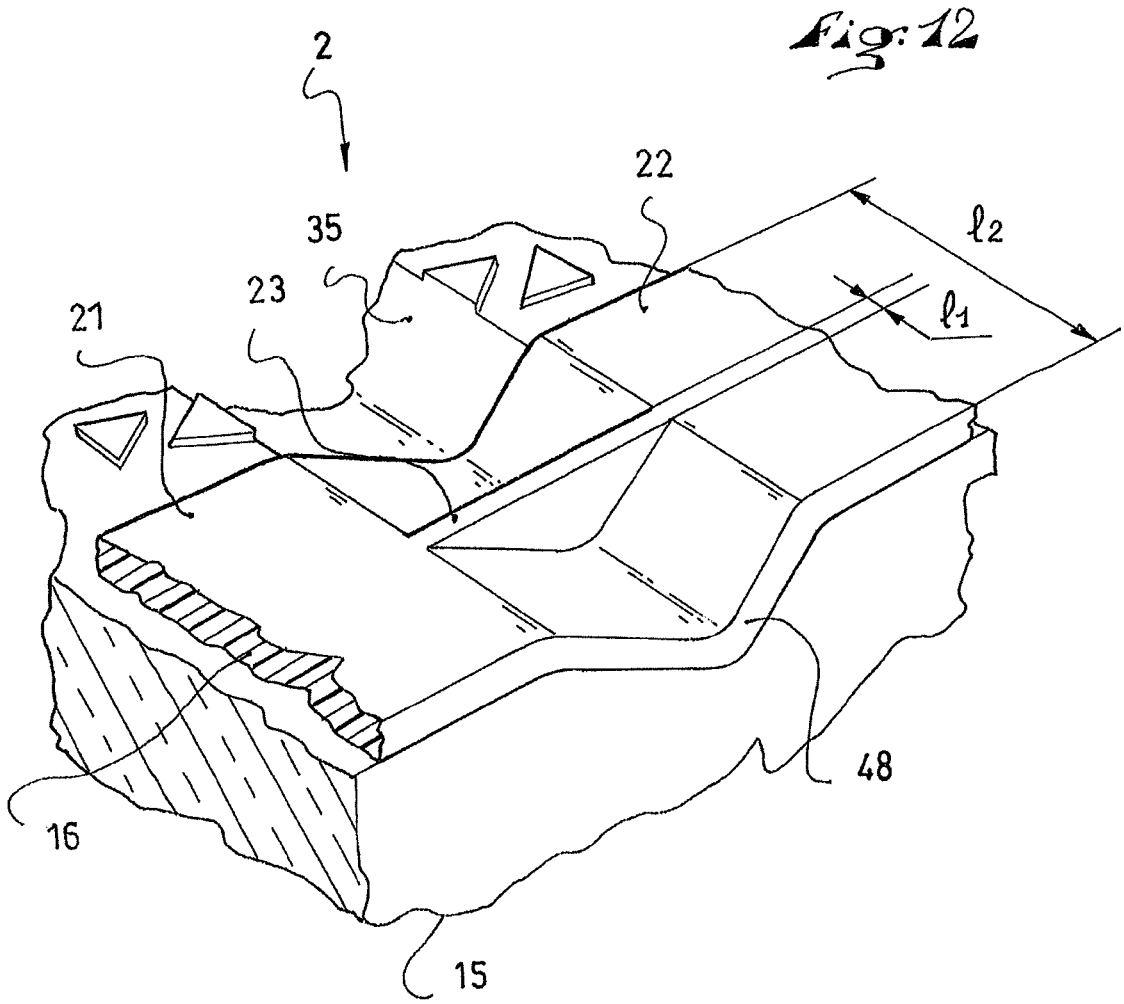
FIG. 12 is a partial perspective bottom view of a shoe according to a seventh embodiment of the invention.

The seventh embodiment is illustrated in FIG. 12. The sole assembly 2 of the shoe 1 still includes a first comfort layer 15 and a reinforcement layer 16, which includes an arch 48 in addition to the first portion 21, second portion 22, and bridge 23. The arch 48 is positioned in a cavity of the comfort layer 15. This cavity is exemplarily designated with reference numeral 35. The portions 21, 22, the bridge 23 and the arch 48 form a continuous subdivision of the reinforcement layer 16. The bridge 23 is fixed to the first 21 and second 22 portions, as well as to the arch. Consequently, the bridge 23 is not fixed to the comfort layer 15.

What is specific to the seventh embodiment is that the bridge 23 is narrow compared to the first 21 and/or second 22 portion. Here, the width $\ell$ 1 of the bridge 23 is comprised between 3% and 30% of the width l2 of the first 21 or second 22 portion. For example, the width $\ell$ 1 of the bridge is comprised between 0.5 mm and 5 mm. An embodiment having a width $\ell$ 1 value within a range of 1 mm to 2 mm yields particularly good results. The width $\ell$ 2 of a portion 21, 22 is comprised between 5 mm and 35 mm. An embodiment having a width $\ell$ 2 value within a range of 10 mm to 20 mm yields particularly good results.

It is noted, according to the seventh embodiment, that the bridge 23 is fixed to the first portion 21, to the second portion 22, as well as to the arch 48. This enables it to play its role of accumulating energy, while facilitating a reversible penetration of the reinforcement layer 16 in loose ground. For this reason, a shoe provided with narrow bridges makes it easier to walk on snow, or in sand.

In a non-limiting manner, the second comfort layer 85 has the same dimensions as the first comfort layer 15, in terms of width and length. In other words, the second comfort layer 85 extends lengthwise from the rear end 4 to the tip 5, and widthwise from the lateral side 6 to the medial side 7. Thus, the increase in comfort is distributed on the entire sole assembly 2.

The invention is embodied from materials and according to techniques of implementation known to those with ordinary skill in the art.

In particular, a comfort layer 15, 85 includes, for example, ethyl-vinyl-acetate, commonly called EVA, or any equivalent material. A reinforcement layer 16 includes, for example, rubber, polyurethane, or any equivalent material.

The invention is not limited to the particular embodiments described and illustrated herein and includes all technical equivalents that fall within the scope of the claims that follow.

For example, the reinforcement layer 16 can be structured and arranged so as not to be flush with the first comfort layer 15 in the case in which it is adapted to contact the ground.

Any cavity 31 to 37 of the comfort layer 15, 85 can contain a foam of synthetic material, entirely or partially, rather than being a completely open cavity. This allows for aesthetic effects, and/or a modulation of the damping by the sole assembly 2.

The embodiments and alternative embodiments have been described hereinabove by way of example, and the invention encompasses any and all equivalent embodiments.

Further, the invention illustratively disclosed herein suitably may be practiced in the absence of any element which is not specifically disclosed herein.

The invention claimed is:

1. An article of footwear comprising:

an upper;

an outer sole assembly comprising:

a reinforcement layer;

a comfort layer located between the reinforcement layer and the upper;

the reinforcement layer comprising:

a first portion, a second portion, a bridge connecting the first portion to the second portion;

the first portion and the second portion being fixed to the comfort layer;

the bridge being beneath and opposite the comfort layer and being spaced from the comfort layer;

the first portion and the second portion having respective ground-engaging surfaces;

the bridge having a ground-engaging surface flush with the ground-engaging surfaces of the first and second portions.

2. An article of footwear according to claim 1, wherein:

the reinforcement layer comprises:

a peripheral piece comprising a medial portion and a lateral portion; and an inner piece positioned between the medial and lateral portions.

3. An article of footwear according to claim 1, wherein:

the reinforcement layer includes a single peripheral piece that extends between a medial side and a lateral side of the sole assembly.

4. An article of footwear according to claim 1, wherein:

the reinforcement layer includes a single S-shaped piece.

5. An article of footwear according to claim 1, wherein:

the reinforcement layer includes a single longitudinally extending and curved piece.

6. An article of footwear according to claim 1, wherein:

the reinforcement layer includes a peripheral belt.

7. An article of footwear according to claim 1, wherein:

the sole assembly includes a second comfort layer.

8. An article of footwear according to claim 1, further comprising:

a plurality of bridges and a plurality of portions connected to one another by means of respective ones of said plurality of bridges.

9. An article of footwear according to claim 1, wherein:

the first portion, the second portion, and the bridge form a unitary, continuous subdivision of the reinforcement layer.

10. An article of footwear according to claim 1, wherein:

the bridge is narrow compared to the first and/or to the second portion.

11. An article of footwear according to claim 1, further comprising:

a plurality of cavities provided in the first comfort layer, at least one of said plurality of cavities being opposite the bridge.

12. An article of footwear according to claim 11, wherein:

the reinforcement layer includes an arch in addition to the first portion, the second portion, and the bridge, the arch being structured and arranged to be opposite the bridge.

13. An article of footwear according to claim 11, wherein:

each of said plurality of cavities is a substantially transverse groove that opens out in the area of the reinforcement layer.

14. An article of footwear according to claim 11, wherein:

at least one of said plurality of cavities is a groove which, together with a line extending in a transverse direction of the shoe, forms an angle ranging between 5° and 30°.

15. An article of footwear according to claim 2, wherein:

the reinforcement layer is flush with the comfort layer.

16. An article of footwear according to claim 1, wherein:

the first comfort layer includes ethyl-vinyl-acetate.

17. An article of footwear according to claim 1, wherein:

the first portion, the second portion, and the bridge of the reinforcement layer comprise a unitary, continuous surface.

18. An article of footwear according to claim 1, wherein:

the first portion, the second portion, and the bridge of the reinforcement layer comprise a unitary, continuous lowermost surface.

19. An article of footwear according to claim 1, wherein:

the first and second portions have a thickness;

the bridge extends longitudinally at a height within the thickness of the first and second portions.

20. An article of footwear according to claim 1, wherein:

the bridge has a length extending between the first and second portions of the reinforcement layer;

the comfort layer extends continuously along and above the length of the bridge.

21. An article of footwear according to claim 9, wherein:

the reinforcement layer comprises additional subdivisions;

each of the additional subdivisions comprises a respective first portion, second portion, and bridge;

the subdivision and all of the additional subdivisions together comprise a unitary, continuous subdivision of the reinforcement layer.

22. An article of footwear according to claim 21, further comprising:

a plurality of cavities provided in the comfort layer;

a respective one of the plurality of cavities being opposite a respective bridge of the additional subdivisions.

23. An article of footwear according to claim 1, wherein:

the bridge comprises a portion of a lowermost surface of the ground-engaging surface of the reinforcement layer.

24. An article of footwear comprising:

an upper;

an outer sole assembly comprising:

a reinforcement layer;

a comfort layer located between the reinforcement layer and the upper;

the reinforcement layer comprising:

a first portion, a second portion, a bridge connecting the first portion to the second portion;

the first portion and the second portion being fixed to the comfort layer;

the bridge being spaced from and opposite the comfort layer;

the comfort layer comprising a plurality of cavities;

one of the plurality of cavities being opposite the bridge;

at least one of the plurality of cavities containing a synthetic foam.

25. An article of footwear according to claim 24, wherein:

the bridge has a length extending between the first and second portions of the reinforcement layer;

the comfort layer extends continuously along and above the length of the bridge.

26. An article of footwear comprising:

an upper;

an outer sole assembly comprising:

a reinforcement layer;

a comfort layer located between the reinforcement layer and the upper;

the reinforcement layer comprising:

a peripheral piece comprising a medial portion and a lateral portion;

an inner piece positioned between the medial and lateral portions;

at least one of the medial portion, the lateral portion, and the inner piece comprising:

a first portion, a second portion, a bridge connecting the first portion to the second portion;

the first portion and the and the second portion being fixed to the comfort layer;

the bridge being spaced from and opposite the comfort layer;

the first portion and the second portion having respective lowermost surfaces;

the bridge having a lowermost surface flush with the lowermost surfaces of the first and second portions.

27. An article of footwear according to claim 26, further comprising:

a plurality of cavities provided in the comfort layer, at least one of the plurality of cavities being opposite the bridge.

28. An article of footwear according to claim 27, wherein:

at least one of the plurality of cavities contains a synthetic foam.

29. An article of footwear according to claim 26, wherein:

the reinforcement layer comprises a ground-engaging layer.

30. An article of footwear according to claim 26, wherein:

the reinforcement layer comprises a ground-engaging surface;

the bridge comprises a portion of the ground-engaging surface.

* * * * *